US006550707B2

(12) United States Patent
Zortman et al.

(10) Patent No.: US 6,550,707 B2
(45) Date of Patent: Apr. 22, 2003

(54) GYRATORY CRUSHER DUST SEAL SYSTEM

(75) Inventors: Brek M. Zortman, Waukesha, WI (US); Albert J. Van Mullem, Sussex, WI (US)

(73) Assignee: Sandvik AB, Sandviken (SE)

( * ) Notice: Subject to any disclaimer, the term of this patent is extended or adjusted under 35 U.S.C. 154(b) by 11 days.

(21) Appl. No.: 09/755,705

(22) Filed: Jan. 5, 2001

(65) Prior Publication Data

US 2002/0088886 A1 Jul. 11, 2002

(51) Int. Cl.[7] ..... B02C 2/06
(52) U.S. Cl. ..... 241/216
(58) Field of Search ..... 241/207–216

(56) References Cited

U.S. PATENT DOCUMENTS

| | | | |
|---|---|---|---|
| 3,924,815 | A | 12/1975 | Haggren |
| 4,179,076 | A | 12/1979 | Barrot et al. |
| 4,384,684 | A | 5/1983 | Karra |
| 4,410,143 | A | 10/1983 | Polinski |
| 4,467,971 | A | 8/1984 | Schuman |
| 4,478,373 | A | 10/1984 | Gieschen |
| 4,519,551 | A | 5/1985 | Ceurvorst |
| 4,659,026 | A | 4/1987 | Krause et al. |
| 4,750,679 | A | 6/1988 | Karra et al. |
| 5,022,593 | A | 6/1991 | Stelk |
| 5,031,843 | A | 7/1991 | Motz |
| 5,080,294 | A | 1/1992 | Dean |
| 5,372,318 | A | 12/1994 | Jacobson |
| 5,769,340 | A | 6/1998 | Jean |
| 5,775,607 | A | 7/1998 | Bayliss et al. |
| 5,803,382 | A | 9/1998 | Ganser, IV et al. |
| 5,810,269 | A | 9/1998 | Shannon |
| 5,915,638 | A | 6/1999 | Jean |
| 5,934,583 | A | 8/1999 | Jean |
| 5,938,133 | A | 8/1999 | Bayliss et al. |
| 5,944,265 | A | 8/1999 | Ganser, IV et al. |
| 5,964,422 | A | 10/1999 | Ruokonen et al. |
| 5,996,916 | A | 12/1999 | Musil |
| 6,007,009 | A | 12/1999 | Sheridan et al. |

*Primary Examiner*—Mark Rosenbaum
(74) *Attorney, Agent, or Firm*—Burns, Doane, Swecker & Mathis, LLP

(57) ABSTRACT

A dust seal system for a gyratory crusher having a shaft and a frame includes a bracket attached to the frame, a dust seal, and a collar. The bracket has a slot into which the dust seal is disposed, and the collar is in contact with the seal during crusher operation.

8 Claims, 2 Drawing Sheets

GYRATORY CRUSHER DUST SEAL SYSTEM

FIELD OF THE INVENTION

The present invention relates to rock crushing systems, such as conical rock crushers or gyratory crushers. More specifically, the present invention relates to a dust seal system for rock crushers.

BACKGROUND OF THE INVENTION

Gyratory rock crushers generally have a downwardly expanding central conical member which rotates or gyrates within an outer upwardly expanding frustroconically shaped member typically called a shell. The shell can be comprised of two or more pieces, e.g., a top shell and a bottom shell. The central conical member generally has a wearing cover or a liner called a mantle. A spider assembly rests on the top shell, forming the top of the support structure for the machine.

A shaft extends vertically through the rock crusher. This shaft is supported by a bearing in the spider assembly. The central portion of the shaft tapers inwardly in an upward direction to form the central conical crushing member. This portion of the shaft supports the mantle, which moves with the shaft to effect the crushing operation. The spider assembly is designed to support the shaft while allowing gyratory movement during operation of the machine. Additionally, the vertical position of the shaft is controlled by a piston arrangement in the spider.

A drive gear and eccentric arrangement effect the gyratory motion of the shaft. This equipment, located at the bottom of the crusher, must be protected from dust and other debris due to crusher operation. Particularly, contaminants must be kept out of the lubrication system. Therefore, gyratory crushers have a dust seal system to keep dust out of these interior workings. A typical embodiment of a conventional dust seal system has a bracket attached to the shaft with a slot containing a floating ring seal. The seal travels on a dust liner cylinder, which is fixed to the frame. The portion of the dust seal system which faces the falling debris must be sloped such that no debris piles up on that component. Disadvantages of these conventional systems are that the bracket is subject to wear because the bracket is in the stream of falling material, and the height of the crusher is increased because of the necessary slope of the bracket to prevent material accumulation.

Therefore, it would be advantageous to have a dust seal system that has decreased space requirements, that protects the bracket from excessive wear, and that allows a reduced crusher height.

SUMMARY OF THE INVENTION

An exemplary embodiment relates to a dust seal system for a gyratory crusher having a shaft and a frame. The system includes a bracket having a slot attached to the frame. A dust seal is disposed within the slot. Further, a collar is attached to the shaft, such that the collar is in contact with the seal.

A further embodiment relates to a gyratory crusher having a shell, a shaft disposed within the shell, and a bracket coupled to a shell. The bracket has a slot with a seal disposed within. The seal has a free end, and a collar coupled to the shaft such that the collar is in contact with the free end of the seal.

A still further embodiment relates to a method for installing or repairing a dust seal of a gyratory crusher having a shaft, a frame, a dust collar, a bracket, and a dust seal. The method includes the steps of raising the shaft to expose the dust seal, and replacing the dust seal.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
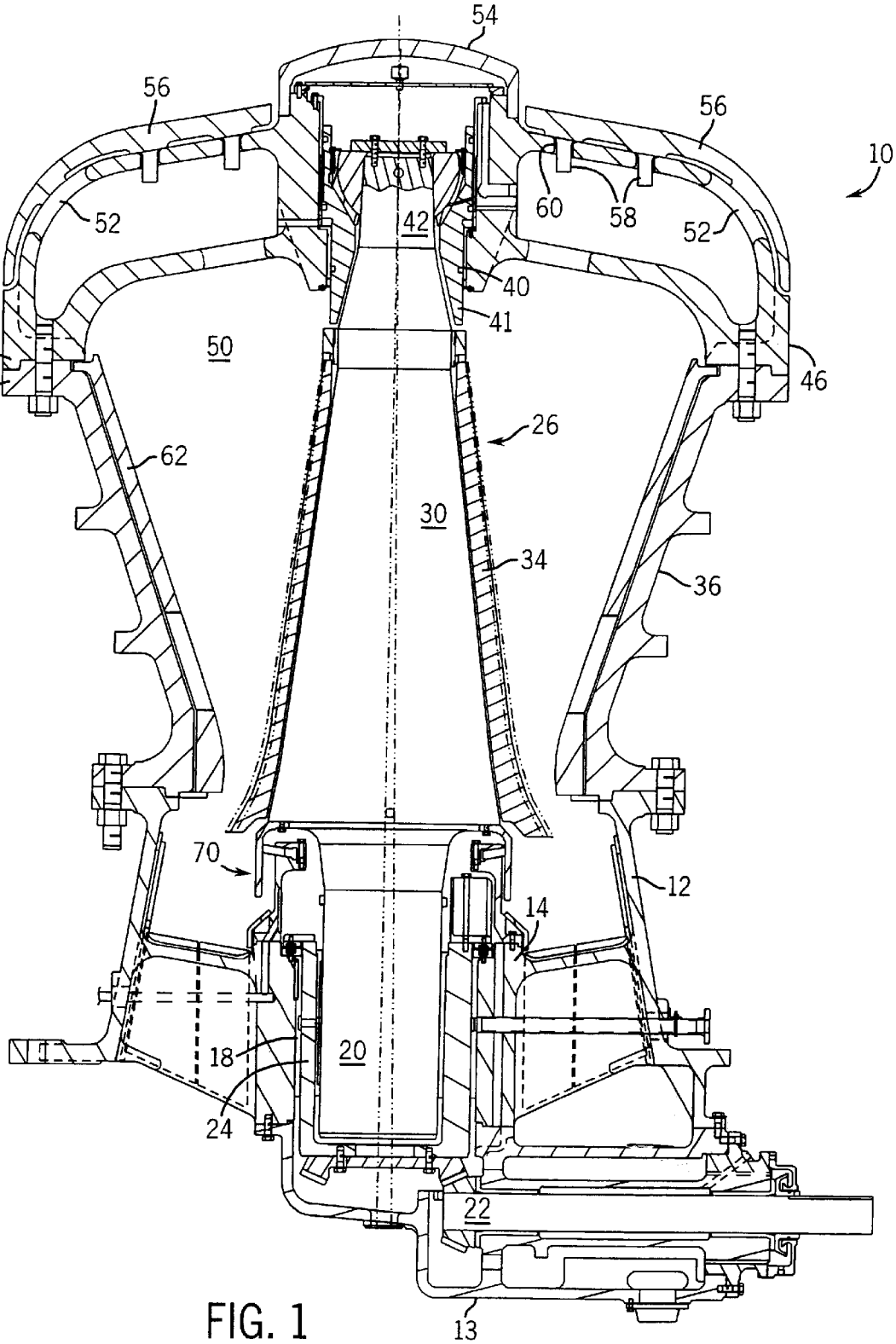
FIG. 1 is a vertical cross-sectional view of the gyratory crusher.

Referring to FIG. 1, a gyratory crusher 10 can be utilized crush rock, ore, minerals, waste, or other material. Gyratory crusher 10 is assembled on a cast steel base or bottom shell 12 having a central hub 14. Central hub 14 is provided with a vertical bore 18 adapted to receive a support shaft 20. This shaft 20 varies in cross section, but extends through the machine into the spider 46. Drive housing 13 extends outwardly from hub 14 to enclose a drive mechanism 22. Drive mechanism 22 causes rotation of an eccentric 24 which directs the gyratory motion of the shaft 20.

A head assembly 26, Which is part of the shaft 20, includes a head member 30 which is covered by a mantle 34. Mantle 34 provides one of the crushing surfaces of crusher 10.

A top shell 36 projects upwardly from bottom shell 12 and is covered by a spider assembly including a spider 46. Alternatively, top shell 36 and bottom shell 12 can be a single piece component. Spider 46 includes an aperture 40 that receives a piston 41 and an end 42 of shaft 20.

Top shell 36 is protected from wear by several rows of concaves 62. These concaves 62 provide the crushing surface opposing mantle 34. Spider 46 can be attached or rest upon top shell 36. Preferably top shell 36 includes a recessed portion 92 for receiving a flange 94 of spider 46. Vertical positioning of shaft 20 with respect to top shell 36 adjusts the relative position of concaves 62 with respect to the mantle 34 of the head member 30, thereby adjusting the size of the crushed material exiting crusher 10.

Material to be crushed is supplied through spider 46 which includes openings (not shown) for entry of the material into crushing cavity 50. A liquid flush apparatus (not shown) may be provided for spraying a liquid such as water toward the crusher cavity 50.

The spider 46 is comprised of spider arms 52 radially extending outward from the center to a spider rim (not shown). A spider cap 54 sits on the top center of the spider 46. Each of the spider arms 52 is protected from falling material by a spider arm guard 56. The spider rim is protected by a rim liner (not shown), also known as a hopper liner.

Figure 2:
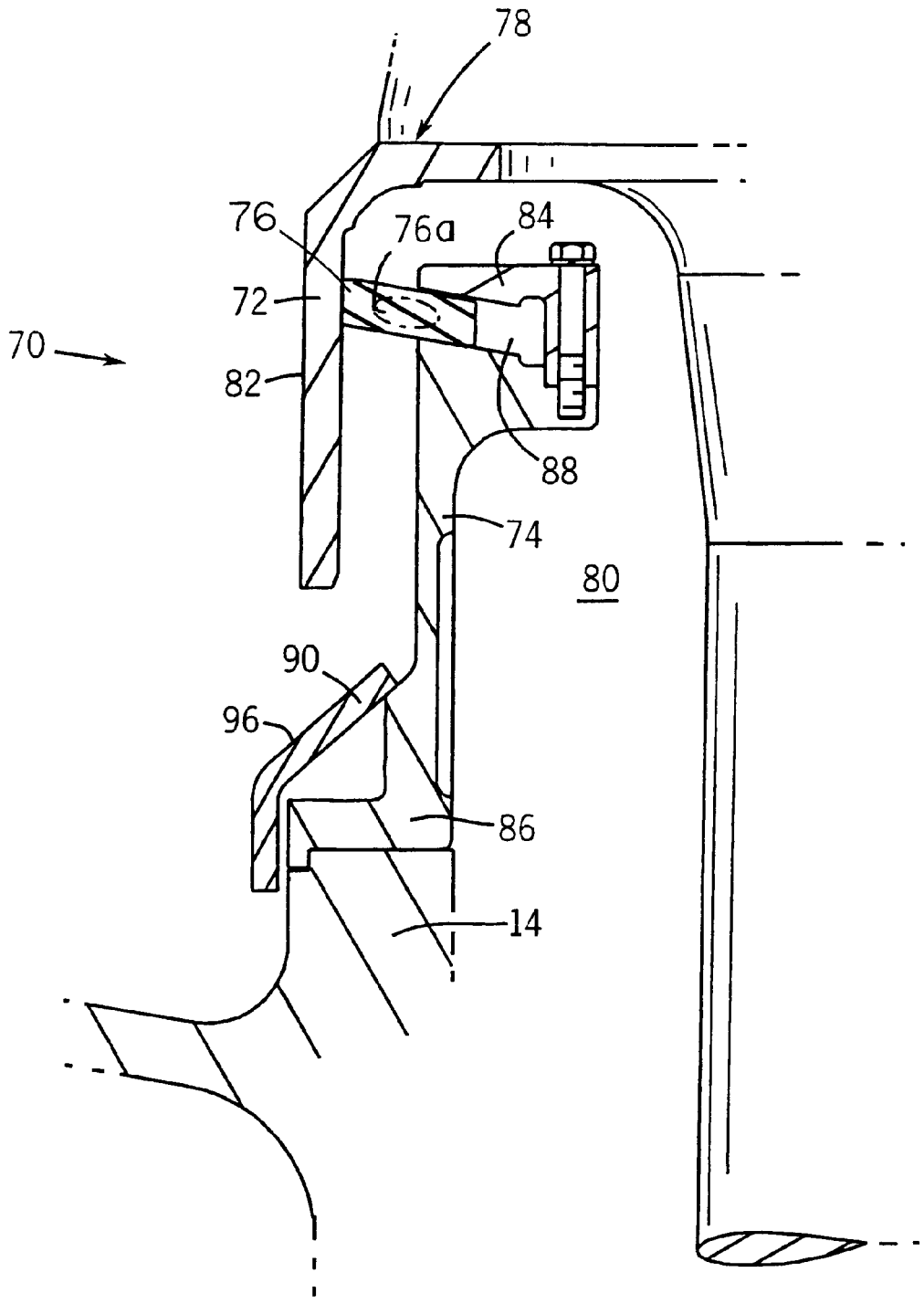
FIG. 2 is a more detailed vertical cross-sectional view of the dust seal system.

Referring now to FIG. 2, a more detailed view of a dust seal system 70 is shown. The major components of the dust seal system are a dust collar 72, a dust seal bracket 74, and a floating ring or dust seal 76. The dust seal system 70 functions to protect an interior region 80 from dust and debris associated with crusher 10 operation. The interior space 80 must be kept free of dust to protect the lubrication systems for eccentric 24 bearings and drive mechanism 22.

The support shaft 20 is cylindrical where it is received in vertical bore 18. However, the shaft tapers outwardly as the transition is made from this region to the head assembly 26 region. The taper is such that a horizontal surface 78 is formed to which the dust collar 72 is attached.

In a preferred embodiment, the dust collar 72 is a steel ring that is attached to the shaft 20 with twelve 24 mm bolts. The collar 72 extends 16.5 inches down from horizontal surface 78, and has inner and outer radii of 53.3 inches and 56 inches respectively. Because the dust collar 72 is fixed with respect to the shaft 20, it gyrates with the shaft 20 and also moves vertically as the shaft 20 is adjusted to compensate for wear. The outer surface 82 of the dust collar 72 is vertical or steeply sloped such that any debris from crushing operations is not retained on the surface 82. Alternatively, dust collar 72 could be integral with shaft 20.

The dust seal bracket 74 has an upper end 84 and a lower end 86. In a preferred embodiment, the bracket is of annular construction, and is made of steel. The upper end 84 has a slot 88 into which the dust seal 76 is disposed. The lower end 86 is attached to the central hub 14 so that it is fixed.

In the preferred embodiment, the dust seal 76 is a ring with a parallelogram cross-section, with an inner radius of about 43.5 inches, an outer radius of about 53.3 inches, and a thickness of 1.7 inches. Alternatively, the dust seal 76 could have a spherical profile. The dust seal 76 is made of polyurethane in the preferred embodiment, but could also be made of aluminum, steel, bronze, or plastic in alternative embodiments. A 1.5 inch 18 gauge steel tube 76*a* is flattened into an oval shape and runs through the center of the dust seal 76 for reinforcement in a preferred embodiment shown in phantom lines in FIG. 2. The dust seal 76 is disposed within slot 88 and also maintains contact with dust collar 72. Thus, the dust seal 76 keeps the interior 80 free of contaminants, as the seal 76 maintains contact between the dust collar 72 and dust seal bracket 74 at all times while the crusher 10 is operating. Additionally, in the preferred embodiment, a passage (not shown) allows air to be pumped into interior space 80 such that the air flows out of the seal through any openings, further preventing ingress of dust.

The dust seal 76 is free floating in that it is not fixed to either bracket 74 or dust collar 72. The seal 76 maintains contact with dust collar 72 during crusher 10 operation by moving in and out of slot 88 to maintain contact with dust collar 72. When dust collar 72 moves away from bracket 74 on one side of the machine, the dust collar 72 is pushing inward on dust seal 76 on the opposing side of the machine, thus forcing dust seal 76 outward on the first side of the machine.

The seal 76 is protected from direct wear and tear from debris by dust collar 72 so in the preferred embodiment, the dust seal 76 has a long operating life. However, if the seal 76 does need to be replaced, the shaft 20 may be raised to expose top end 84 of bracket 74, therefore allowing the seal 76 to be easily replaced. Because this design has the slot 88 facing outward, the seal 76 is much easier to replace than it is with conventional designs having the retaining slot 88 facing toward the machine center. When the slot 88 faces the machines center the view of workers replacing the seal is obscured, making the job dangerous, especially as the shaft 20 is lowered over the dust seal 76.

Below the dust collar 72 is a liner 90 that protects the lower end 86 of bracket 74 from debris. An outer face 96 must be sloped such that debris does not remain on liner 90. The liner 90 is at a forty-five degree slope to prevent debris build-ups. Liner 90 may be bolted onto bracket 74 such that liner 90 is fixed with respect to central hub 14.

If the just described arrangement of dust seal 70 were reversed as in conventional systems with the bracket 74 attached to shaft 20 on the exterior and the dust collar 72 attached to central hub 14 on the interior, the angled outer surface 96 of liner 90 would have to be longer to ensure that there would be no horizontal surfaces allowing collection of debris. This would be a drawback, because the 45 degree angle of repose of outer surface 96 would travel over a greater vertical distance such that the greater horizontal span could be covered. The vertical distance encompassed by liner 90 directly correlates to the required length of shaft 20. Thus, the conventional arrangement that requires a longer outer surface 96 increases the required length of shaft 20, increasing the overall height of crusher 10 and accordingly, the cost of the machine.

An alternative arrangement eliminating the sloped liner 90 would have required a much larger diameter bracket 74. The larger diameter bracket 74 would exceed the diameter of the head 30, exposing the bracket 74 to direct wear from failing material. Additionally, the larger bracket would weigh more, and be more costly to manufacture.

The dust seal system 70 described above reduces wear on the bracket 74 by keeping it out of the downward flow of crushed material, as opposed to previous systems that have the bracket on the exterior side. This is especially important in higher power machines that have increased shaft diameters, pushing the dust seal system 70 outward from the protected area under head assembly 26. Bracket 74 is precisely machined, and therefore more expensive to replace than collar 72 if worn.

The gyratory crusher 10 operates as follows. When the drive mechanism 22 is driven by any appropriate means, it transmits power to the eccentric 24. The eccentric 24 causes the gyration of the head assembly 26, resulting in the crushing of the material in the crushing chamber 50. The phantom lines flanking the mantle and center axis on FIG. 1 indicate the range of gyratory motion.

The above arrangement solves the longstanding problems discussed in the Background of the Invention section because the dust seal bracket 74 is protected from wear and tear by keeping it to the interior of the dust collar 72. Additionally, the reduced height requirement for the liner 90 allows the overall height of the crusher 10 to be reduced. Further still, the overall dust seal arrangement is less bulky because the bracket is kept to the interior of the dust collar 72. Finally, the dust seal 76 is easier and safer to replace due to its outward-facing position.

While several embodiments of the invention have been described, it should be apparent to those skilled in the art that what has been described is considered at present to be the preferred embodiments of a dust collar system 70. However, in accordance with the patent statutes, changes may be made in the design without actually departing from the true spirit and scope of this invention. The following claims are intended to cover all such changes and modifications which fall within the true spirit and scope of this invention.

What is claimed is:

1. A gyratory crusher, comprising:

a shell;

a shaft disposed within the shell;

a bracket coupled to the shell, the bracket having a slot;

a seal disposed within the slot, the seal having a free end; and a collar coupled to the shaft wherein the collar is in contact with the free end of the seal.

2. The gyratory crusher of claim 1 wherein the seal is made of polyurethane.

3. The gyratory crusher of claim 1 wherein the dust seal has a steel tube insert.

4. The gyratory crusher of claim 1 wherein the collar is located outside of the bracket.

5. The gyratory crusher of claim 1 wherein the dust seal is a ring with a parallelogram cross-section.

6. The gyratory crusher of claim 1 wherein the seal is arranged to maintain its free end in contact with the collar during rotation, gyration and axial movement of the shaft relative to the shell.

7. The gyratory crusher of claim 1 wherein the seal is disposed inside of the collar.

8. The gyratory crusher of claim 1 wherein the shaft extends substantially vertically, the collar disposed at a lower end of the shaft; the seal projecting from the slot in a direction having an upward component.

* * * * *